US008621791B2

(12) United States Patent
Mualla

(10) Patent No.: US 8,621,791 B2
(45) Date of Patent: Jan. 7, 2014

(54) DAMPING SYSTEM

(75) Inventor: Imad H. Mualla, Frederiksberg (DK)

(73) Assignee: Damptech A/S, Kgs. Lyngby (DK)

( * ) Notice: Subject to any disclaimer, the term of this patent is extended or adjusted under 35 U.S.C. 154(b) by 0 days.

(21) Appl. No.: 13/501,094

(22) PCT Filed: Oct. 2, 2010

(86) PCT No.: PCT/DK2010/050250

§ 371 (c)(1),
(2), (4) Date: Jun. 27, 2012

(87) PCT Pub. No.: WO2011/038742

PCT Pub. Date: Apr. 7, 2011

(65) Prior Publication Data

US 2012/0260585 A1 Oct. 18, 2012

(30) Foreign Application Priority Data

Oct. 2, 2009 (JP) ..... 2009-230593
Jun. 24, 2010 (DK) ..... 2010 00567

(51) Int. Cl.
*E04B 1/98* (2006.01)
*E04H 9/02* (2006.01)

(52) U.S. Cl.
USPC ..... 52/167.3

(58) Field of Classification Search
USPC ..... 52/167.1, 167.3, 167.4, 167.7; 248/569, 248/567, 562
See application file for complete search history.

(56) References Cited

U.S. PATENT DOCUMENTS

| | | | | | |
|---|---|---|---|---|---|
| 4,057,237 | A * | 11/1977 | Nemeth | 267/134 |
| 4,409,765 | A * | 10/1983 | Pall | 52/167.1 |
| 4,922,667 | A * | 5/1990 | Kobori et al. | 52/167.2 |
| 6,223,483 | B1 * | 5/2001 | Tsukagoshi | 52/167.1 |
| 7,647,734 | B2 * | 1/2010 | Sarkisian | 52/167.3 |
| 2001/0045069 | A1 * | 11/2001 | Constantinou | 52/167.3 |

FOREIGN PATENT DOCUMENTS

| | | | |
|---|---|---|---|
| GB | 2041490 | A * | 9/1980 |
| JP | 10 280660 | A | 10/1998 |
| WO | 01/09466 | A1 | 2/2001 |
| WO | 02/090681 | A1 | 11/2002 |

* cited by examiner

*Primary Examiner* — Christine T Cajilig
(74) *Attorney, Agent, or Firm* — Nordic Patent Service

(57) ABSTRACT

A damper has two sets of first elongate members, second elongate members that are connected so that they can rotate and that connect the first elongate members to one another, and damping members which attenuate the relative movement between the first elongate members and the second elongate members. The respective first joints of each of the first members are connected to the first connection members and the second connection members so that they can rotate. The first joint of the first elongate member, the first joints of the other first elongate members, and each of the second joints are located along the common axes.

18 Claims, 19 Drawing Sheets

DAMPING SYSTEM

FIELD

The aspects of the disclosed embodiments generally relate to a damping system which protects a structural body from a dynamic stress such as the stress of an earthquake, the shock of a large sea wave, or a stress that is produced by vibration and the like caused by shocks from transportation, machines, wind, or the like.

BRIEF DESCRIPTION OF RELATED DEVELOPMENTS

When a structural body of a construction, such as a building, e.g. a house or a high rise oscillates due to external forces acting on the construction, there is a risk that horizontal movement of the structural body will occur. Sometimes, in high-rise buildings or towers, when these external forces are not effectively absorbed, the structural body is seriously damaged, which may lead to a collapse of the structure.

Hydraulic dampers that are used as devices to absorb this type of external force are known in the art and a typically used in building constructions. In addition to the shock absorbing devices that use hydraulic dampers to passively absorb an external force, there are also structures that respond to external conditions to actively absorb shock; however, not only is the cost of production of such a structure high, but such dampers need a lot of space to fit into the construction.

A damper, which is equipped with a side plate, a center plate which extends within a mostly horizontally flat surface, and a friction member located between the side plate and the center plate, is shown in WO 2002 090681. As for the side plate and the center plate, in addition to holding the frictional member, each of these members are connected so that they can be rotated, using bolts, which penetrate them, and nuts. This damper is configured such that, when the side plate and the center plate turn in relation to one another, the friction that is created between them and the frictional member produces an damping force, and that the damping force can be adjusted through the amount of tightening on the bolts.

However, in some cases the degree of freedom in positioning the prior art dampers within the structural body is limited. The prior art damper is configured such that the side plate and the center plate rotate centered on the frictional member. For this reason, the external force is input such that it causes a rotational movement, centered on the frictional member, at both ends of the side plate and at the end of the center plate: in other words, it is necessary that the side plate and the center plate be shaken. Therefore, in order, for example, to suppress the horizontal oscillation of a frame, positioning was limited such that in some cases one end of the center plate had to be installed in the general central area of an upper beam of the structural body, and the two ends of the side plate had to be connected to the two ends of a lower beam, connected by the long axis member receiving the tension.

Thus it would be advantageous to provide a damping system with a high degree of freedom in regard to the location of its installation.

SUMMARY

Thus, the above described object and several other objects are intended to be obtained in a first aspect of the disclosed embodiments by providing a damping system for the damping of oscillations of a structural body or constructions, which construction comprises a plurality of structural members or elements, comprises the following: at least two groups or sets of the first elongate members; at least one set of second elongate members connected to the two sets of first elongate members such that they can be rotated with respect to each other; at least one damping member (which is positioned between the two sets of first elongate members and the one set of second elongate members and which dampens the rotational movement between them), a first connection member, and a second connection member; each first elongate member has on its first end portion first joint adapted for joining it to a structural member; the first joint of the first elongate member of the prior art is located at the other ends of the other first elongate members, the first joints of the first elongate members are connected to the first connection members, and the first joints of the other first elongate members are connected to the second connection members; the first connection members and the second connection members are connected, respectively, at each of their second joints to the structural member of the two sets of first elongate members; in the prior art, the second joint is located at the intersection of the first connecting member's first center axis and the structural member, and the other second joint is located at the intersection of the second connection member's second center axis and the structural member; in the prior art, the first center axis passes through the first joint of the first elongate member, and the second center axis passes through the first joint of the other first elongate member; in the prior art, the second elongate member is located between the first joint of the first elongate member and the first joint of the other first elongate member, and in the prior art, the first joint of the first elongate member, the first joint, and each joint of the second member of the other first elongate member are located lined up along the same common axis.

As for the damping system that is mentioned above, it is configured from first members, second elongate members, and damping members that produce damping force at rotational sections, so that there are few parts and so that the system is simple. In addition, along with having the two joints of the first elongate members facing to opposite sides, they are also joined, at second members between these joints, such that the first elongate members and the second members can rotate relative to one another. What is more, the first joints of the first elongate members in the prior art, the first joints of the other first members, and each of the second joints are located along common axes. By configuring them in this way, they can accommodate the linear input of external force.

In another embodiment, the damping system may also be such that, when the first joint of the first elongate member in the prior art moves in the opposite direction from the first joint of the other first elongate member, the first elongate members move proximally toward one another, and, when the first joint of the first elongate members in the prior art move proximally toward the first joints of the other first elongate members, the first elongate members may move in the opposite direction from one another.

In a further embodiment, the damping system may also be such that when the longitudinal axis of the first elongate member and the longitudinal axis of the second member cross, the interval between each of the first elongate members is at its largest. By configuring it in this way, when each member moves in order to suppress oscillations, it is not necessary to create space so that they do not interfere with one another, allowing for space savings.

In a further embodiment, the damping system may also be such that it has a plurality of second elongate members, and that each of the second elongate members are positioned parallel to one another, facing the first elongate members longitudinally.

In addition, it may also be such that the first elongate member and the second elongate member are overlaying one another in alternation by means of the damping member. By using a layered configuration, it is possible to absorb a larger oscillation energy.

In addition, it may also be such that the damping members produce damping force using the friction that is created on the plates that are in contact with the first elongate members and the second elongate members.

In addition, it may also be such that the damping member is made from an elastic material.

In addition, it may also be such that the first elongate members and the second elongate members have pressing mechanisms to compress the damping members.

In addition, the pressing mechanism for the damping system may also be such that the compression force is adjustable.

In addition, the pressing mechanism may also be such that a spring member is used to energize the compression force that the first elongate members and the second elongate members compress the damping member with.

In addition, the pressing mechanism may also be such that it has at least one disc spring as the spring member, affixed using bolts and nuts, with the bolt passed through a perforation consisting of the first hole, made in the joint of the first elongate member, of the second hole, made in the second elongate member in a position correlating to the first hole, of the third hole, made in the damping member in a position correlating to the first hole and the second hole, and of the fourth hole, made in the disc spring in a position correlating to the first through third holes, and with a nut affixed to the tip of the bolt where it protrudes from the perforation.

In addition, the pressing mechanism may also be such that it has several disc springs. By adjusting the number of disc springs, it is possible to easily adjust the damping strength.

In addition, it may also be such that the first joint of the first elongate member in the prior art of the damping system, and the first joint of the other first elongate member, are joined so that they can be rotated.

In addition, it may also be such that the first and the second connection sections of the damping system are connected to the structural members so that they can be rotated.

In addition, it may also be such that one or both ends of the first and the second connection sections of the damping system are connected to assisting members of the structural members of the structural body.

In addition, as for the damping system, it may also be such that it has rectangular frame structures configured from the structural members, that it is equipped with one set of inclined beams configured from the structural members that are configured in "v" configurations with each one end affixed at each corner of the frame structures, that the first joints are connected to the assembled ends of the inclined beams, and that the second joints are connected to the structural members that are located opposite to the assembled ends.

In addition, as for the damping system, it may also be such that it has a rectangular frame structure configured from the structural member, that the first connection member is connected to the corner of the frame structure in the prior art, and that the second connection member is connected to the corner that is positioned diagonally to the corner of the frame structure in the prior art.

In addition, as for the damping system, it may also be such that it has two plate-type structural members that are positioned diagonally, that the first joints are connected to the plate-type structural members in the prior art, and that the second joints are connected to the other plate-type structural members.

Throughout this document the terms "comprising" or "comprises" do not exclude other possible elements or steps. Also, the mentioning of references such as "a" or "an" etc. should not be construed as excluding a plurality.

BRIEF DESCRIPTION OF THE DRAWINGS

The damping system according to the disclosed embodiments will now be described in more detail with regard to the accompanying figures. The figures show one way of implementing the aspects of the disclosed embodiments and are not to be construed as being limiting to other possible embodiments falling within the scope of the attached claim set.

DETAILED DESCRIPTION OF THE DISCLOSED EMBODIMENTS

Below follows a description of aspects of the disclosed embodiments, referring to the figures. In the below description, a structural member is understood to include e.g. pillars, beams, stiffeners, stretchers, v-braces and the like, and any member which maintains the rigidity of a structure of a construction or structural body of e.g. a building or the like.

Figure 1:
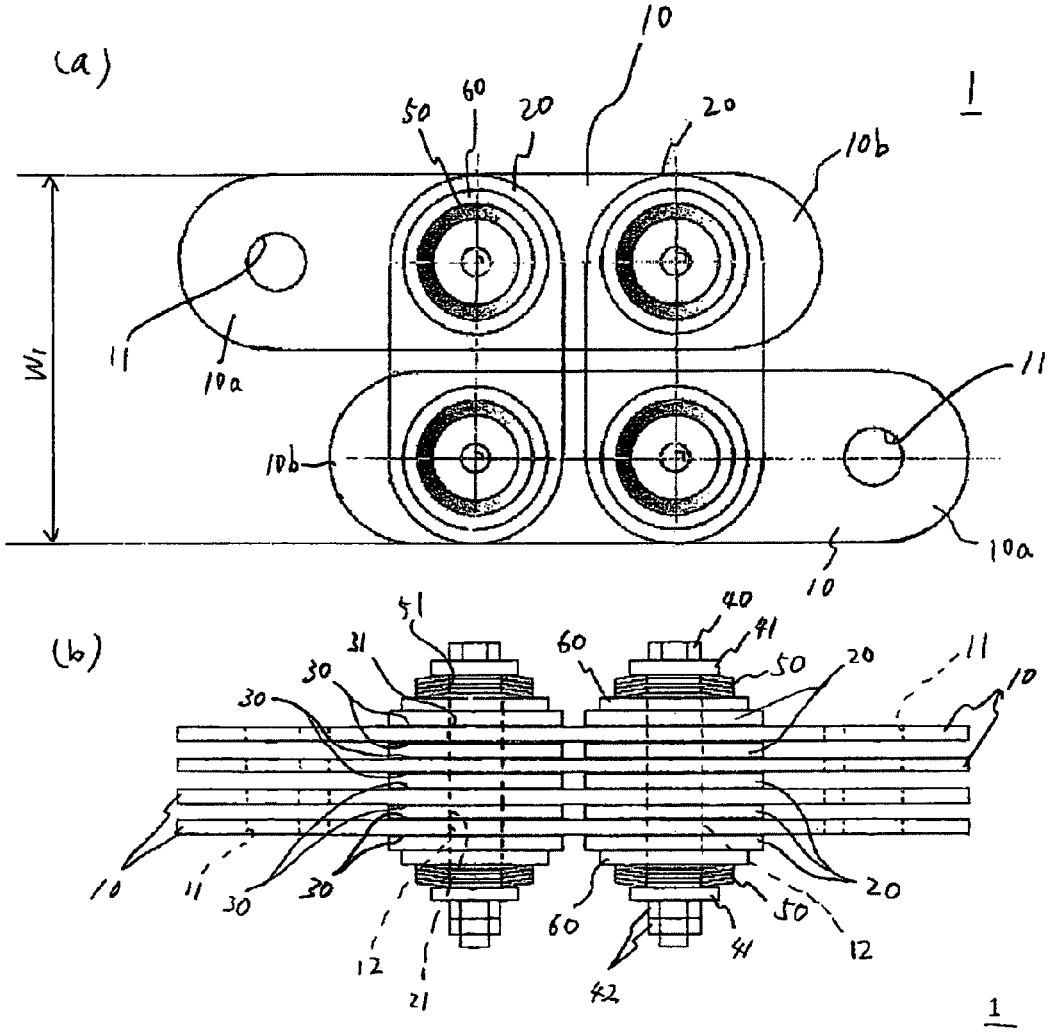
FIG. 1, in side view and a top view, shows one embodiment of a damper for a damping system.

FIG. 1(*a*) shows a side view of a damper for damping movements/oscillations in a construction for a system according to one embodiment. FIG. 1(*b*) shows a top view of the same damper.

The damper 1 comprises: two sets of the first elongate members 10; two sets of second elongate members 20; and damping members 30 sandwiched between the two sets of the first elongate member 10 and the two sets of second elongate members 20. The second elongate members 20 are connected to the two sets of the first elongate members 10, such that they may rotate with respect to each other, in rotational connections.

The first elongate members 10 are formed from rectangular-shaped plates. A first joint 11 is provided in a first end portion 10*a* of these plates. The first joint 11, is adapted for connection to a structural member, as will be described later, and may as shown take the form of holes or apertures through the plates constituting the set of first elongate members 10.

In the shown embodiment, the rotational connections are made as holes or openings 12, 21 passing through the first elongate members 10, and second elongate members 20, and each of the rotational connections are formed in series along the longitudinal axis of the first elongate members 10. Further the rotational connections may be provided as shown by a bolt 40 which extends through the respective elongate members 10, 20 and joins them together, with a nut 42 affixed to one end of said bolt 40. A clamping member 50 in the form of e.g. a disc spring 50, and washers 41, 60 may further be attached via the bolt and nut.

The two sets of first elongate members 10 are arranged in parallel. The first joints 11 of the first end portion 10*a* of the one set of first elongate members 10 are arranged adjacent to the second ends 10*b* of the other set of first elongate members 10. That is to say that the first joints 11 of the two sets of first elongate members 10 are arranged at opposite ends 1*a*, 1*b* of the damper 1.

The one or more sets (two sets are shown in FIG. 1) of elongate second elongate members 20, are arranged between the respective first joints 11 of the two sets of the first elongate members 10 that are arranged oppositely to each other on the damper 1 as described above.

The two sets of second elongate members 20 are arranged so as to be parallel to one another. These two second elongate members 20 are also rectangular-shaped plate members, with holes or apertures 21, that forms part of the rotational connections, together with the holes or apertures 12 in the first elongate members 10.

For the material of the first and second elongate members 10, 20, metals, resins, ceramics, carbon fibers, and the like may be used.

The damping member 30 may be made from a friction material or from a visco-elastic material. It is provided for damping movements between the sets of first elongate members 10 in relation to the sets of second elongate members 20. In cases where friction materials are used for the damping member 30, when the first elongate members 10 move in relation to the second elongate members 20, friction is produced between the surfaces of these members and the surfaces of the damping member 30, and, due to this, the movement between the second elongate members 20 and the first elongate members 10 is dampened/attenuated. Further, the damping member 30 also dampens the creaking noise that is would otherwise be produced from the relative movement of the respective elongate members.

For the friction material, it is preferable that compound materials can be used, from materials such as brass and aluminum, or, optionally, alloys of brass and aluminum, or compound fiber materials such as plastic and glass, carbon, or Kevlar (registered trademark) and the like, or, optionally compound fiber materials such as ceramic materials and glass, carbon, Kevlar (registered trademark) and the like.

In the case that visco-elastic materials are used for the damping members 30, for example, rubber, acryl polymers, copolymers, optionally glass-like materials and the like, it is possible to use a material which disperses energy when it receives shear deformation. The energy from when the second elongate member 20 moves relative to the first elongate member 10 is attenuated, subsequent to the polymer deformation, through the relief and the recovery of the polymer.

As shown in the figure the damping member may be a of disc shape and with an opening, hole or aperture 31, to correspond to the respective holes 12, 21 the first elongate members 10 and in the second elongate members 20.

In the damper 1, shown in FIG. 1, there are eight first elongate members 10 (four in each set), ten second elongate members 20 (five in each set), and 16 damping members 30.

There are four first elongate members 10 stacked in each set. Further, there are five second elongate members 20 stacked in each one set.

When FIG. 1(*a*) is referred to, two of the first elongate members 10 are lined up so that each others' first joint 11 are facing the opposite side, and two of the second elongate members 20 are located to bridge said first elongate members 10, and a total of four damping members 30 are inserted in the space between each first elongate member 10 and each second elongate member 20. The one-set-assemblies, each comprised of two first elongate members 10, two second elongate members 20, and four damping members 30, are layered in four layers, with the first elongate members 10 and the second elongate members 20 overlaying one another in alternation using the damping members 30.

Further, there are two second elongate members 20 set up on the bottom of the lowest layer assembly using four damping members 30. There are washers 60 located on the surface of the second elongate members 20 that are located in the uppermost layer and on the surface of the second elongate members 20 that are located in the lowermost layer, respectively. There are clamping means 50 in the form of disc springs arranged on the outer surface of each of these washers 60. The clamping means/disc springs 50 functions as an energizing method to energize the compression or clamping force, pressing the first elongate members 10 and the second elongate members 20 together and towards the damping members 30. There may be provided holes or apertures 51 in the disc springs 50 that also correspond to the holes 12, 21, and 31 to provide the abovementioned rotational connection. There may be washers 41 arranged on the opposite side of the disc springs 50 with respect to the washers 60. The bolts 40 are passed through the washers 41, the holes 60, the holes 12, and the holes 21, 31, and 51, and the nuts 42 are affixed to the tips of the bolts where they protrude from the holes. The nut 42 is to prevent loosening, so a double nut is used.

As for the damper 1 of the present embodiment, the compression or clamping force that first elongate member 10 and the second elongate member 20 press on the friction member 30 can be adjusted using the amount of tightening on the nuts 42, the spring constant of the disc springs 50, or the number of layers of disc springs 50.

By increasing the spring constant of the disc spring 50, the amount of tightening on the nut 42, or the number of layers of disc springs 50, the compression force is increased, allowing the damping force to be augmented. On the other hand, by decreasing the spring constant of the disc spring 50, the amount of tightening on the nut 42, or the number of layers of disc springs 50, the compression force is decreased, allowing the damping force to be lowered.

Figure 2:
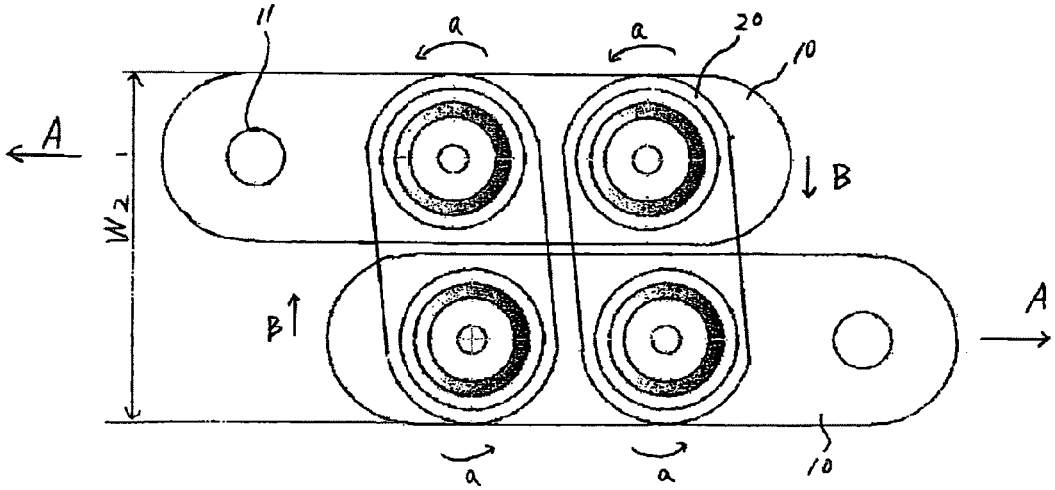
FIG. 2, shows the damper of FIG. 1 and illustrates operating the a damper for a damping system.

Next, the operation of the dampers 1 that are used in the damping system of the present embodiment is explained while referring to FIG. 2. FIG. 2 is a flat drawing which shows the dampers 1 when the force in the direction (the direction of arrow a) of the pulling force on the dampers 1 has been received.

FIG. 1(*a*) shows that, when the force in the direction (the direction of arrow A) of the pulling force on the dampers 1 has been received, each of the first joints 11 move away from one another: that is to say, each of the first elongate members 10 move away from one another. Along with this, the second elongate members 20 move relative to the first elongate members 10 (in the direction of arrow a). The movement energy at the time of movement is absorbed by the damping members 30. As noted above, each of the first elongate members 10 connected such that they can be rotated by two second elongate members 20, which are located parallel to one another. For this reason, each of the first elongate members 10 also move in the direction that brings them closer together (in the direction of arrow B in FIG. 2). In other words, each of the first elongate members 10 and each of the second elongate members 20 operate linked in parallel, using the respective joints 12 as links. What is more, while it is not illustrated, when applying pressure force to the damper 1 as shown in FIG. 1(*a*), that is to say, even when external force is applied from the direction opposite to that of arrow A, each of the first elongate members 10 also move in the direction that brings them closer (in the direction of arrow B in FIG. 2).

Since the dampers 1 of the present embodiment operate as discussed above, the width W1 (the width of the outer portion of the first elongate member 10) of the damper 1 is widest when it is as shown in FIG. 1(*a*), that is to say, when the longitudinal axis of the first elongate member 10 and the longitudinal axis of the second elongate member 20 are at right angles. On the other hand, when the pull force or compression force, is applied to the dampers 1, the widths W2 of the dampers 1 are smaller than W1. In other words, when the dampers 1 are operating causing damping force to be produced, the dampers 1 will not expand wider than width W1. Therefore, it is necessary only to provide, in the sideways direction, enough space for width W1 for dampers 1 when setting up dampers 1 in structural bodies. In this way, since the configuration of the dampers 1 is such that, even though pull force or compression force is applied to it, width W1 does not expand, so it is possible to save space.

In addition, for the dampers 1 of this embodiment, damping of the movement energy takes place in the rotational movements of each member, but the direction of the force that is applied to the damper 1 is linear. In other words, the damper 1 converts the linearly input force into rotational movement, and the rotational movement energy is attenuated/dampened. In this way, since the input direction for the external force is linear, it becomes possible to install the damper 1 at any location within the structural body.

The damping system, with the dampers 1 of the present embodiment installed and configured in the construction or structural body is explained with reference to FIGS. 3-5.

Figure 3:
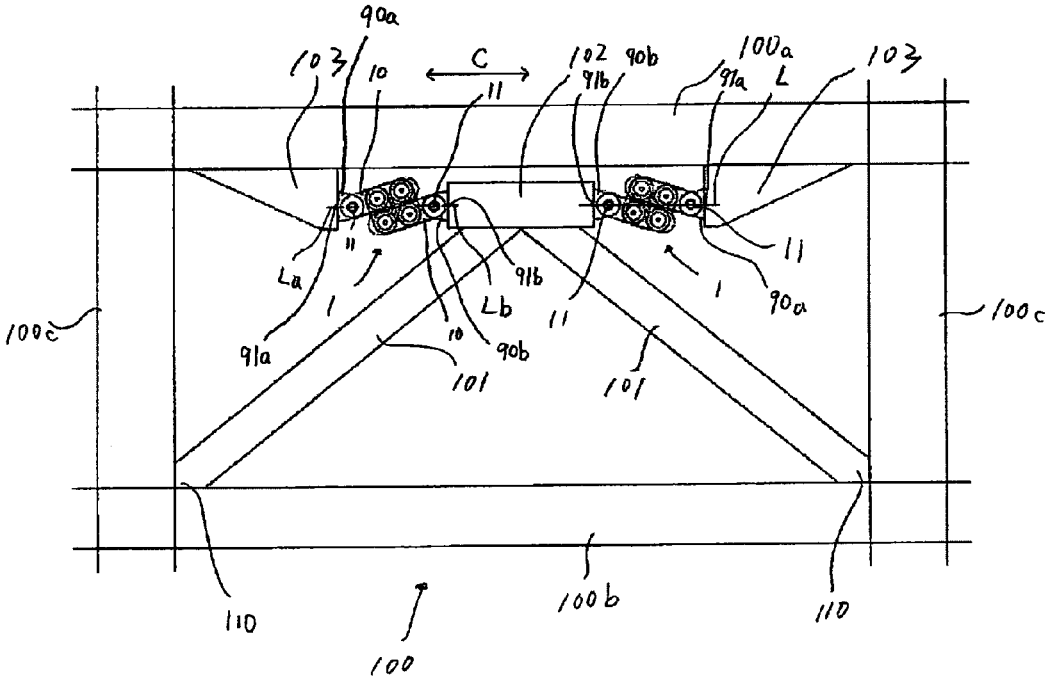
FIG. 3 illustrates one embodiment of the system where a damper as shown in FIG. 1 applied to a V-beam section of a frame structure of a construction.

The damping system, with the dampers 1 installed and configured at the v-beam provide within the frame structure, is shown in FIG. 3.

Figure 4:
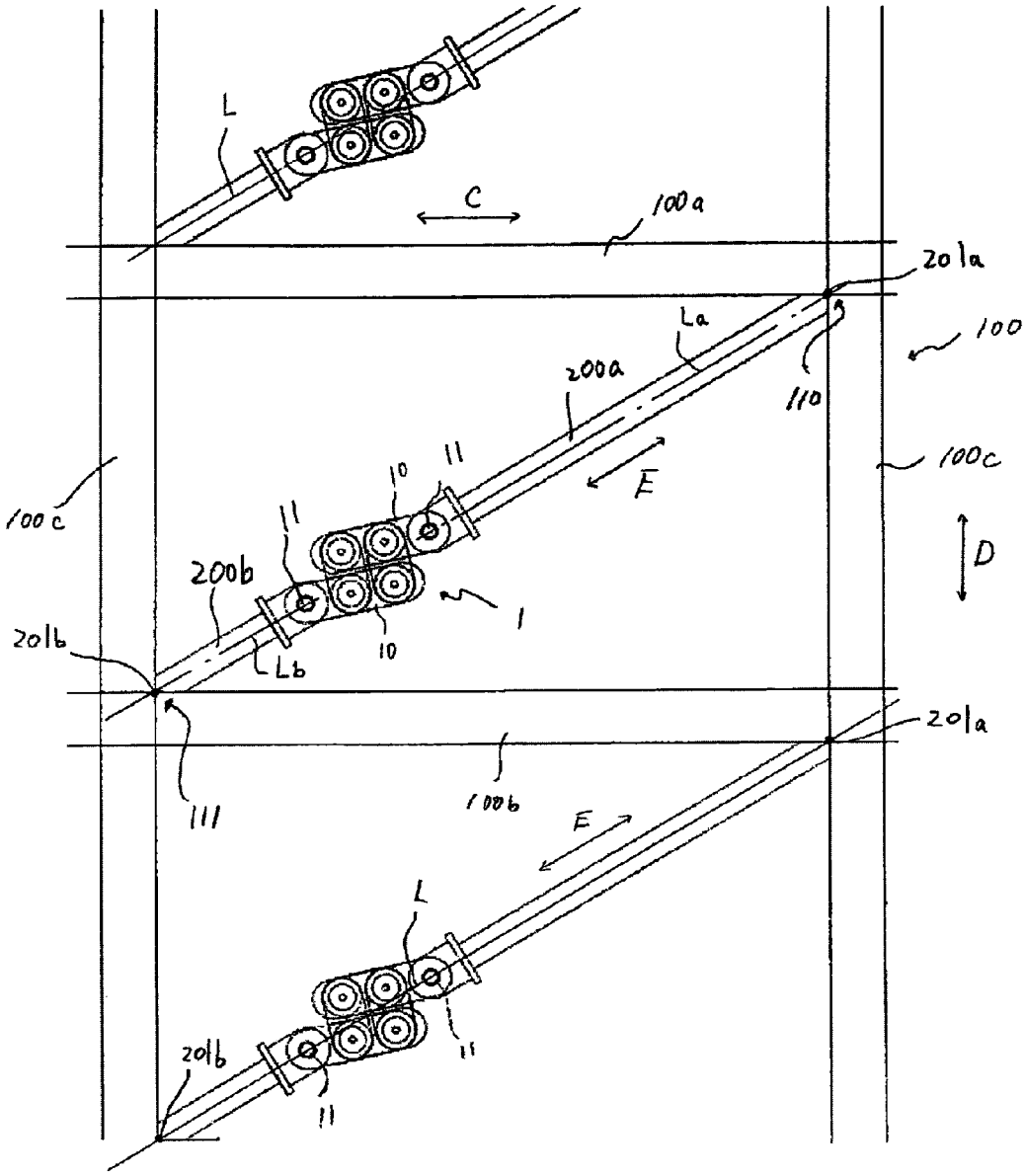
FIG. 4 illustrates another embodiment of a damping system in accordance with the disclosed embodiments, where dampers as shown in FIG. 1 are arranged in a diagonal manner in a frame structure of a construction.

Frames 100 of the construction may be formed by a number of structural elements or members such as beams as is shown in FIGS. 3 and 4. A Frame 100 may comprise two structural members 100*c* arranged so that their longitudinal axes are vertical, and structural members 100*a*, 100*b* are arranged horizontally, so that they connect the structural members 100*c*. In FIG. 3, there are two structural members 101 installed at an incline at the two corners 110 of said frame structure 100, forming a "v" shaped beam structure beam. The two inclined beams 101 meet at a rectangular small beam, or intermediate beam 102.

Further, the structural member 100*a* that is located adjacent to the small beam 102 is equipped with two reinforcement parts 103. The reinforcement parts 103 make up part of the structural member 100*a*. The small beam 102 is arranged between the two reinforcement parts 103. Two dampers 1 are located in the spaces between the small beam 12 and the reinforcement parts 103. In other words, there are a total of two dampers 1 that are located with one each at the two side surfaces of the two sides of the small beam 102.

The dampers 1, at the first end 1*a*, the first joints 11 are rotatably connected to first connection members 90*a*, and at the opposite end 1*b*, the first joints 11 are rotatably connected to second connection members 90*b*. The first connection members 90*a* are rotatably connected to the reinforcement parts 103 at second joints 91*a*, and the second connection members 90*b* are rotatably connected to the small beam 102 at the second joints 91*b*.

Here, the second joints 91*a* are located at the intersections of the first center axis La of the first connection members 90*a* and the reinforcement parts 103, and the second joints 91*b* are located at the intersections of the second center axis La of the second connection members 90*b* and the assembled ends 102.

Further, the first center axes La pass through the first joints 11 of the first elongate members 10 that are located in the upper part in FIG. 3, and the second center axes Lb pass through the first joints 11 of the first elongate members 10 that are located in the lower part in FIG. 3.

Further, the first joints 11 of the two first elongate members 10, which are located above and below, and the second joints (91*a* and 91*b*) are located along the common axis L.

When the frame structure 100 oscillates, e.g. due to an earthquake, or traffic, in the horizontal direction (in the direction of arrow C), then the damper 1 converts those oscillations to rotational movements, and said horizontal oscillations are absorbed by the damping member 30.

FIG. 4 shows another embodiment of a damping system where a damper 1 is arranged in a diagonal of frame 100 if a constructions.

The frame structures or frames 100 are comprised of the two vertical structural members 100*c*, and the structural members 100*a*, 100*b*) are horizontal so that they form a connection of the structural members 100*c*. Further, FIG. 4 displays an example of this type of frame structure installed in a continuous series, but, since each of them has the same type of structure, there are explanations made for only one part of it. In addition, in the description of FIG. 4, there are three dampers 1 shown as an example, but the phrases "sets of first elongate member 10 located at the upper side" and the "sets of first elongate member 10 located at the lower side" refer to the internal relationship of the locations inside of one of these three dampers 1.

There is one damper 1 that is installed on top of the beam that connects to two diagonally opposed corners 110,111 or intersections of the structural elements 100*a*, 100*b*, 100*c*, of the frame structure 100.

In other words, the first joint 11 of one set of first members 10 that is located on the upper side (in the figure) of the damper 1 is rotatably connected to the first connection member 200*a*, and the first joint 11 of the other of the set of first members 10 that is located on the lower side of the damper 1 is rotationally connected to the second connection member 200*b*. The first connection member 200*a* is connected to the corner 110 at the second joint 201*a*, and the second connection member 200*b* is connected to the corner 111 at the second joint 201*b*.

Here, the second joint 201*a* are located at the intersections of the first center axis La of the first connection member 200*a* and the corner 110, and the second joint 201*b* is located at the intersections of the second center axis Lb of the second connection member 200*b* and of the corner 111.

Further, the first center axis La pass through the first joints 11 of the first elongate members 10 that are located at the upper side, and the second center axis Lb pass through the first joint 11 of the one set of first elongate members 10 that are located at the lower side. In addition, the first joints 11 of the two first elongate members 10 that are located above and below, and the second joints (201*a* and 201*b*) are located along the common axes L.

When the frame 100 oscillates in the horizontal direction (in the direction of arrow C in FIG. 4), or when it oscillates in the vertical direction (in the direction of arrow D in FIG. 4), the first connection member 200*a* and the second connection member 200*b* will apply the force in the direction of arrow E. This force in the direction of the arrow E is applied to the damper 1 as pulling force or as compression force. Linear movement of the first elongate members 10 is converted to rotational movement by the second elongate members 20 and the movement energy is absorbed by the damping members 30.

In the FIG. 4 embodiment the diagonal beams or braces designated 2001 and 200*b*, and described above as first and second connection members may, also form structural members of the building, such that the damper 1 may be connected to these structural elements or beams 200*a*, 200*b* via short first and second connection members 200*c*, 200*d* (In the embodiment described above 200*c*, 200*d* forms parts of connection members 200*a*, 200*b*).

Figure 5:
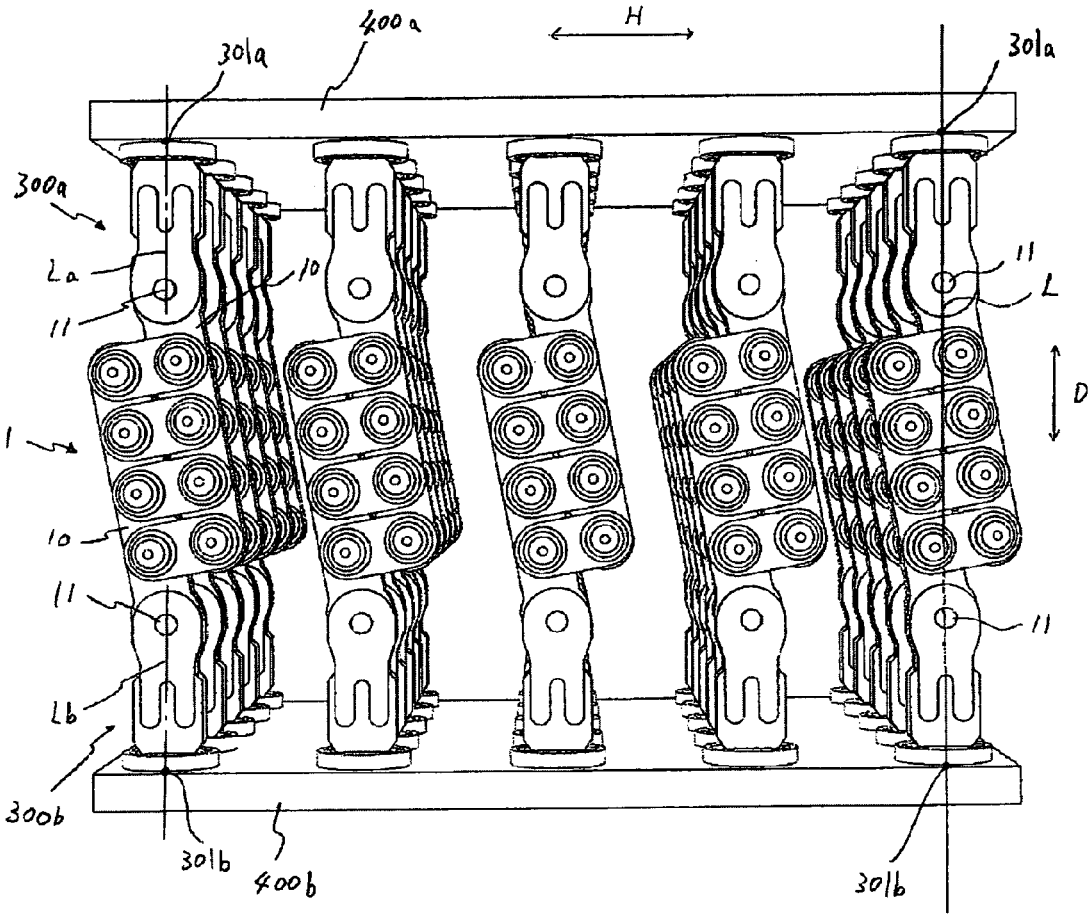
FIG. 5, in a perspective view, illustrates another embodiment of a damping system, where dampers as shown in FIG. 1 are arranged between e.g. wall or floor surfaces of a construction.

FIG. 5 shows an another embodiment of the damping system. In this embodiment two opposing wall surfaces 400*a*, 400*b* are equipped with a plurality dampers 1. The surfaces 400*a*, 400*b* may also represent floors or a wall/floor and another structural part of a building, e.g. a mount for machinery. Further, in FIG. 5, five rows of dampers 1 are shown located, from left to right, and there are also five rows of dampers 1 located from front to back, for a total arrangement of 25 dampers 1; the phrases "the first elongate members 10 located on the right side" or "the first elongate members 10 located on the left side" refer to the internal relationship of the locations inside of one of these 20 dampers 1.

The two wall-type structural members 400*a*, 400*b* are located facing one another, and there is a plurality of dampers 1 located between these structural members 400*a*, 400*b*.

As for the dampers 1, the first joint 11 of the first elongate member 10 located on the right side is connected to the first connection member 300*a* such that it can turn, and the first joint 11 of the first elongate member 10 located on the left side is attached to the second connection member 300*b* such that it can turn. The first connection member 300*a* is connected to the structural member 400*a* at the second joint 301*a*, and the second connection member 300*b* is connected to the structural member 400*b* at the second joint (301*b*). What is more, the connection between the first connection members 300*a* and the structural members 400*a* and the connections between the second connection members 300*b* and the structural members 400*b* may also be connections that can turn in the direction of revolution taking the direction d in the figure as the axis of the revolution.

Here, the second joints 301*a* are located at the intersections of the first center axes La of the first connection members 300*a* and the structural members 400*a*, and the second joints 301*b* are located at the intersections of the second center axes Lb of the second connection members 300*b* and the structural members 400*b*.

What is more, the first center axes La pass through the first joints 11 of the first elongate members 10 that are located on the right side in FIG. 5, and the second center axis Lb pass through the first connective sections 11 of the first elongate member s10 that are located on the left side in FIG. 5.

In addition, the first joints 11 of the two first elongate members 10 that are located on the left and on the right, and the second joints 301*a*, 301*b* are located along the common axes L.

In FIG. 5, the structural member 400*a* is drawn as a wall that is located above the dampers 1, and the structural member 400*b* is drawn as a wall that is located below the dampers 1. The dampers 1 do not only absorb oscillations in the vertical direction (in the direction of arrow D in FIG. 5): for example, the heavy weight of a heavy mass on the structural members 400*a* can also be supported. In other words, it is possible, by adjusting the number of the dampers 1, the number of or the spring constant of the disc springs 50, or the amount of tightening of the bolts 40, to not only suppress oscillations but also to support the weight of heavy masses. In other words, it is possible to use the dampers 1 themselves as structural members.

What is more, in FIG. 5, the structural members 400*a*, 400*b* are shown located from top to bottom, but the structural members 400*a*, 400*b* can also be located from left to right. In this case, the dampers 1 operate to suppress horizontal oscillations.

In addition, the interval between the structural members 400*a* and the structural members 400*b* can be adjusted, as appropriate, from about 10 cm to about 10 m, but it may also be narrower than 10 cm or wider than 10 m.

What is more, in each of the examples discussed above, the first connection members 90*a*, 200*a*, and 300*a* or the second connection members 90*b*, 200*b*, and 300*b* may also be installed at the structural members using assisting members that are not shown.

Figure 6:
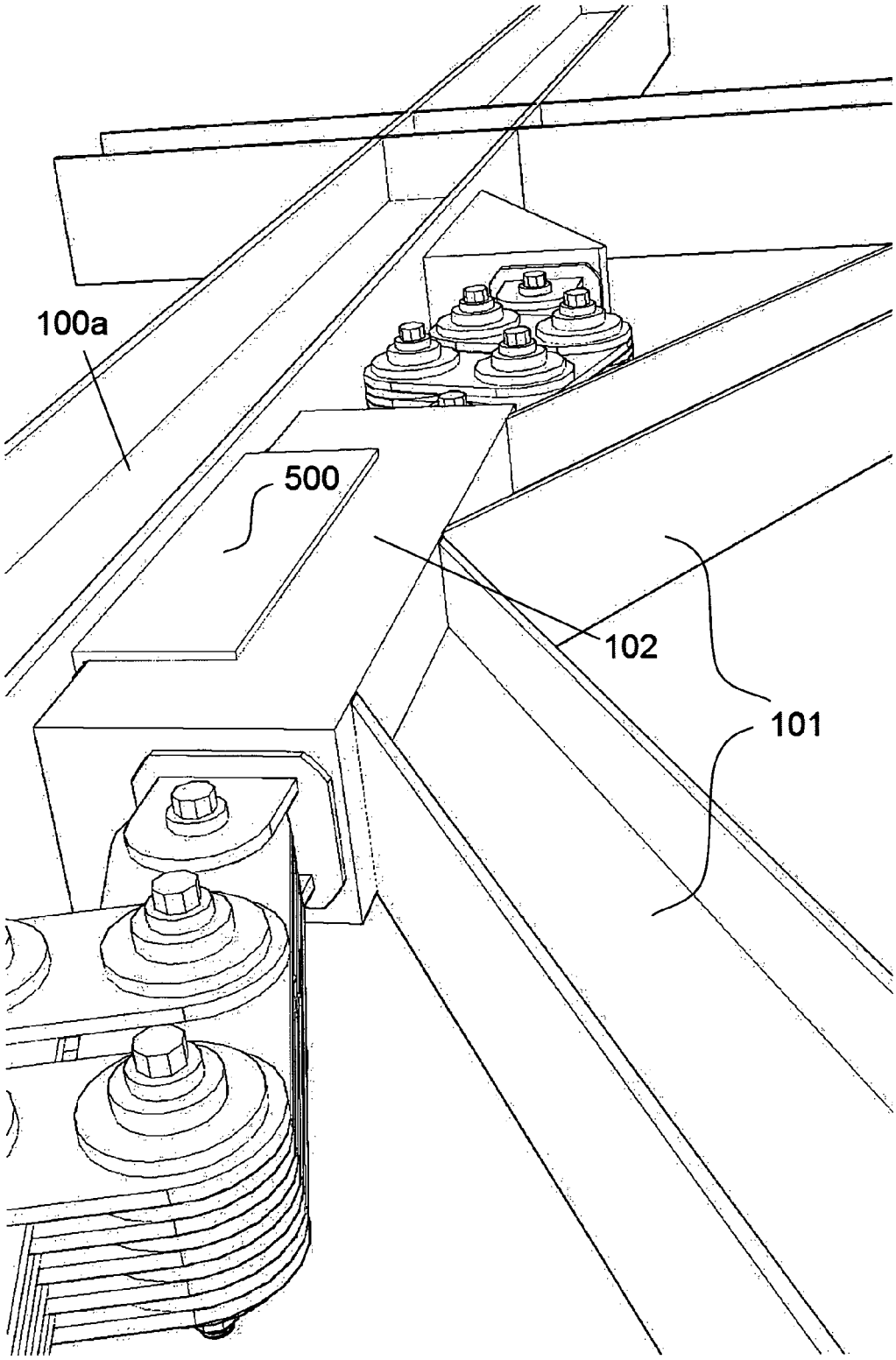
FIGS. 6 and 7, in two different perspective views, show details of a system such as shown in FIG. 3.
Figure 7:
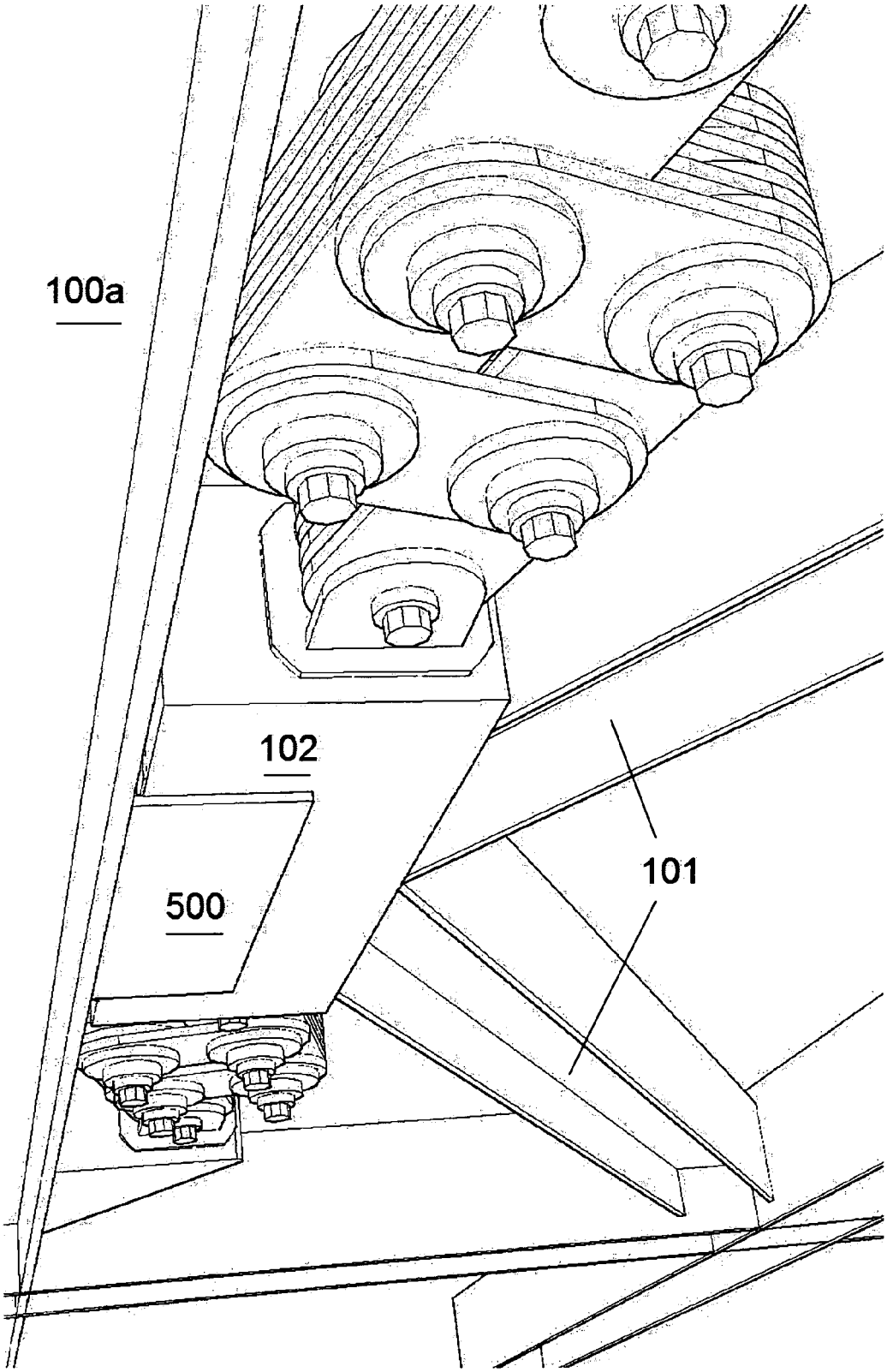
Figure 8:
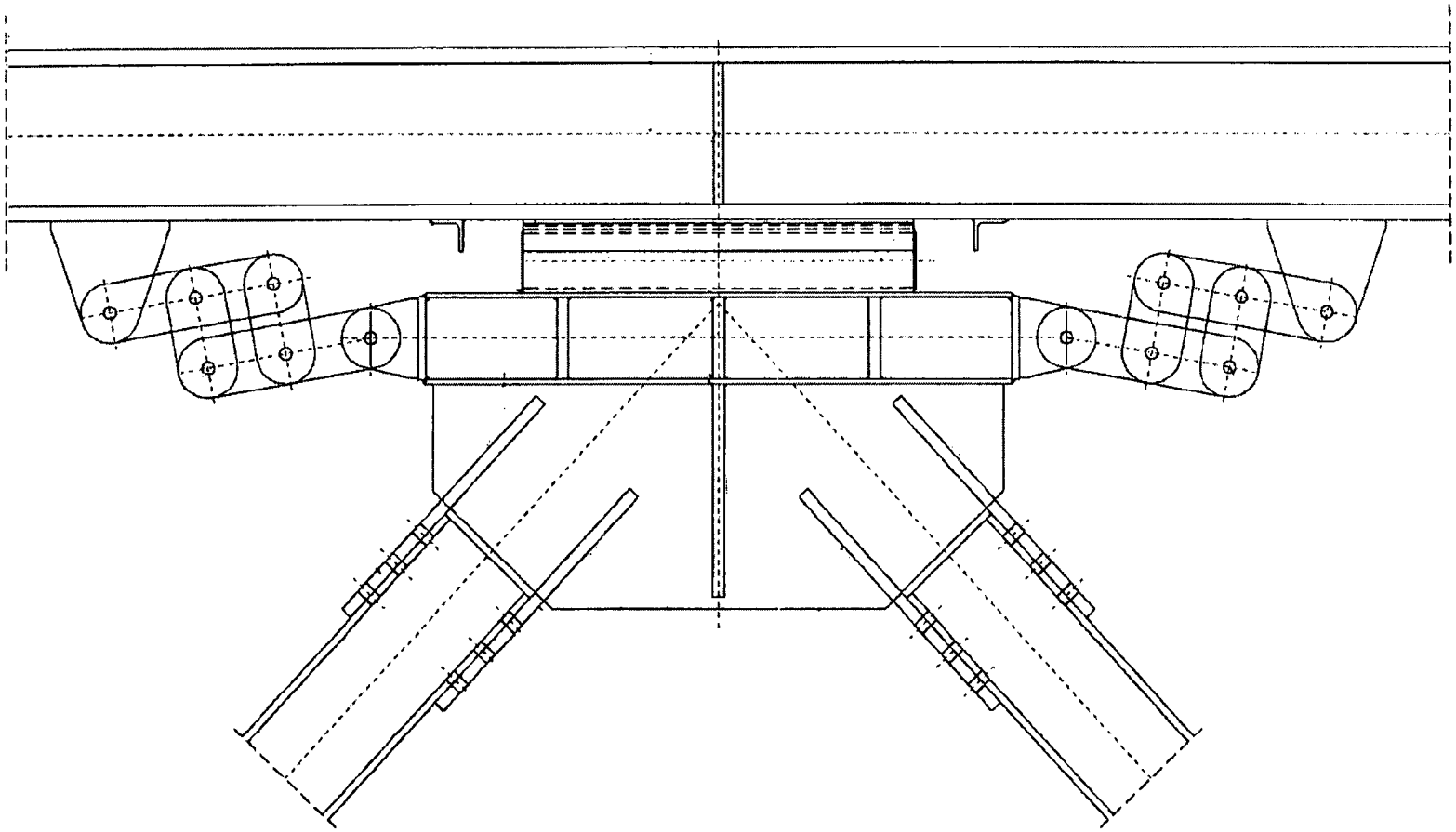
FIG. 8, in a side view, shows details of a damping system of such as shown in FIGS. 6 and 7.
Figure 9:
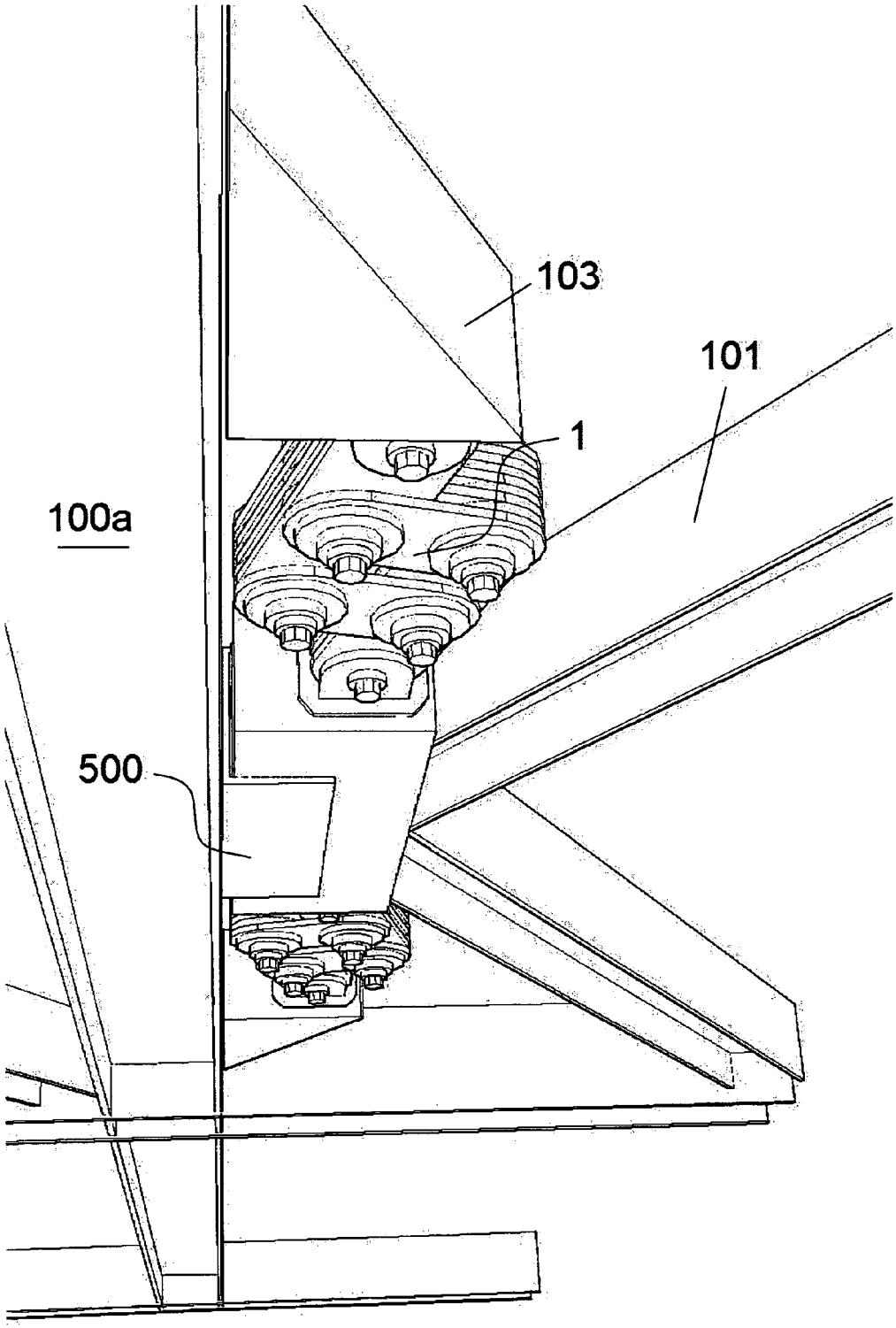
FIGS. 9-11, and 13, in different perspective views, show variations of a damping system.
Figure 10:
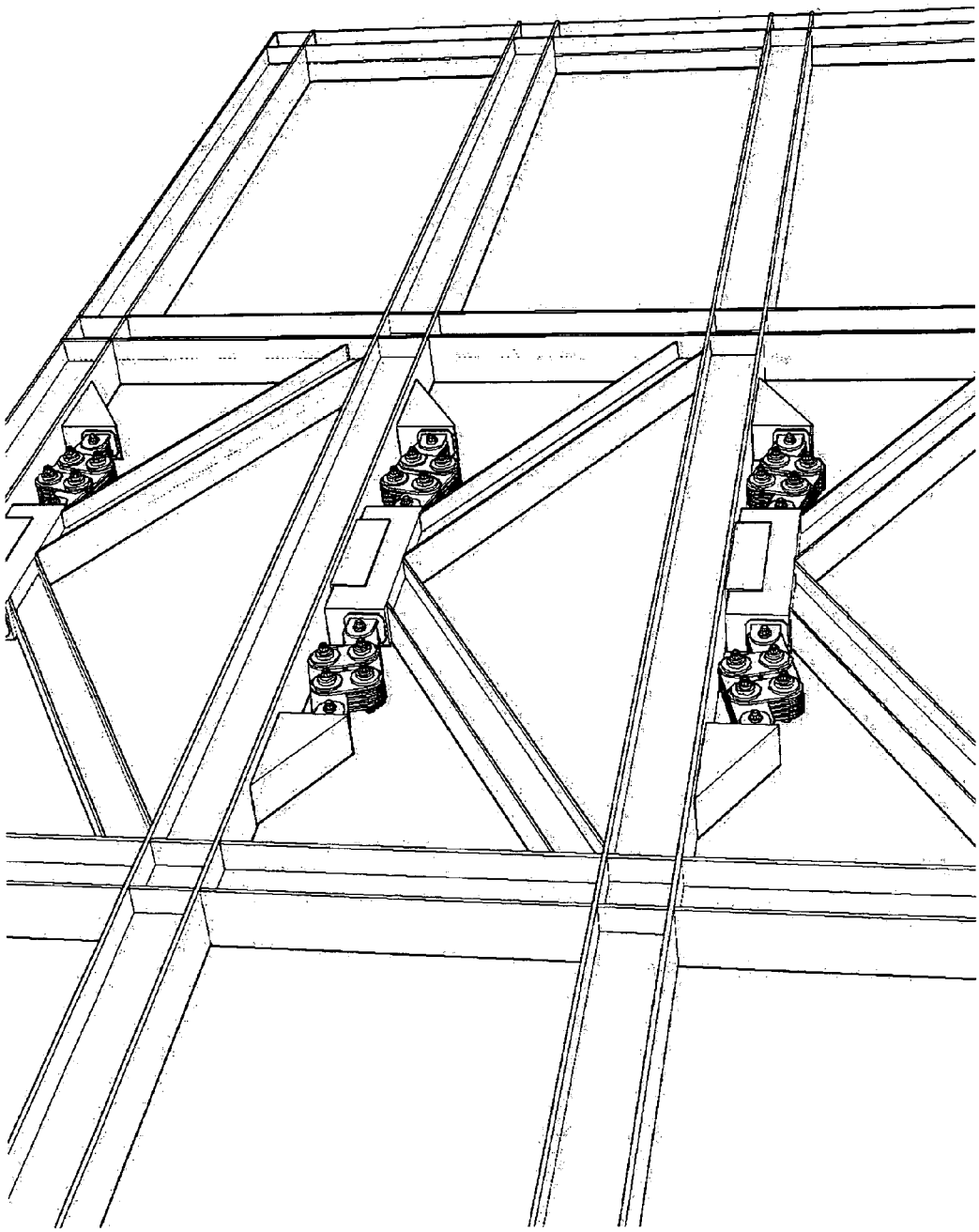
Figure 11:
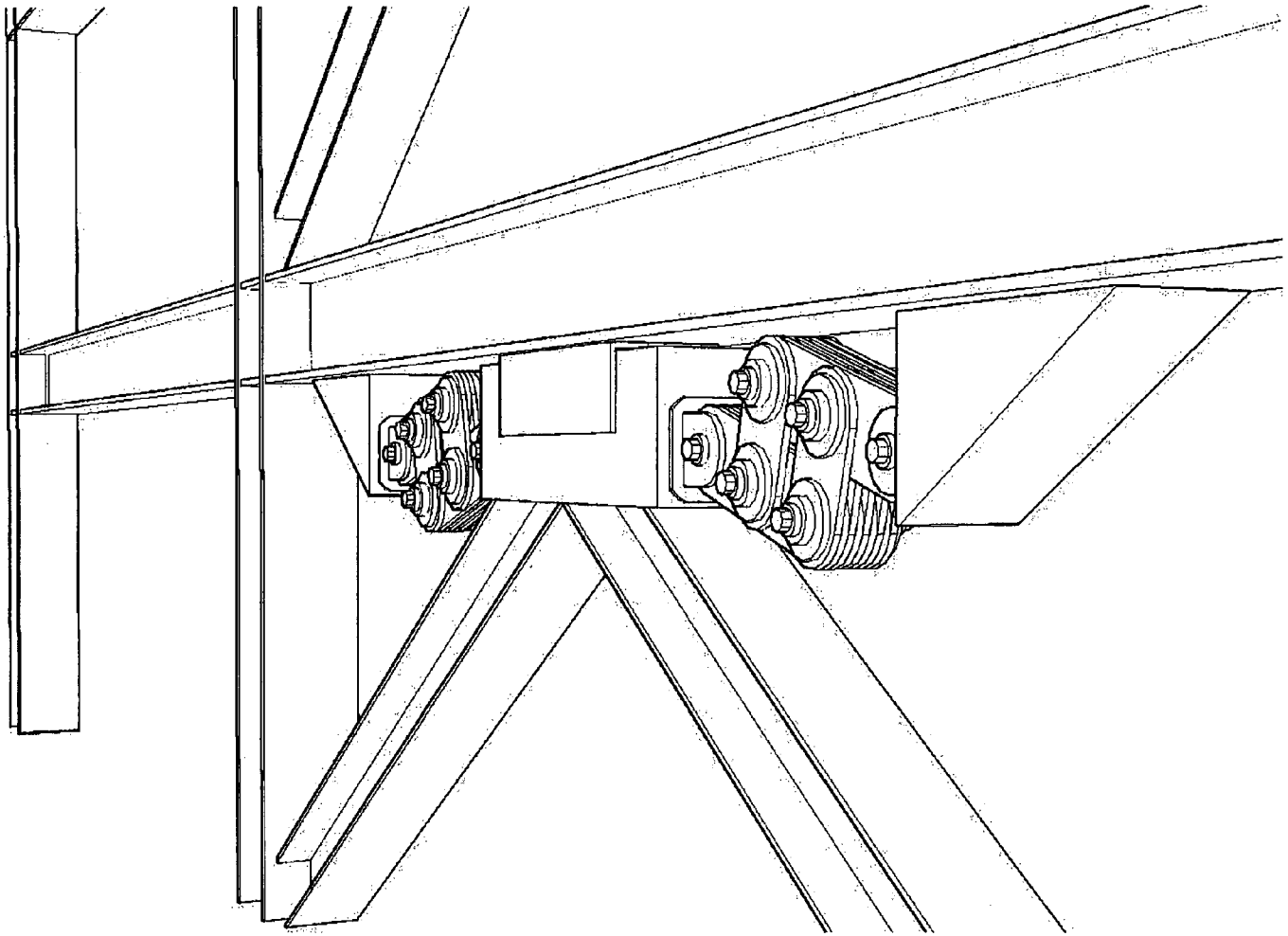
Figure 12:
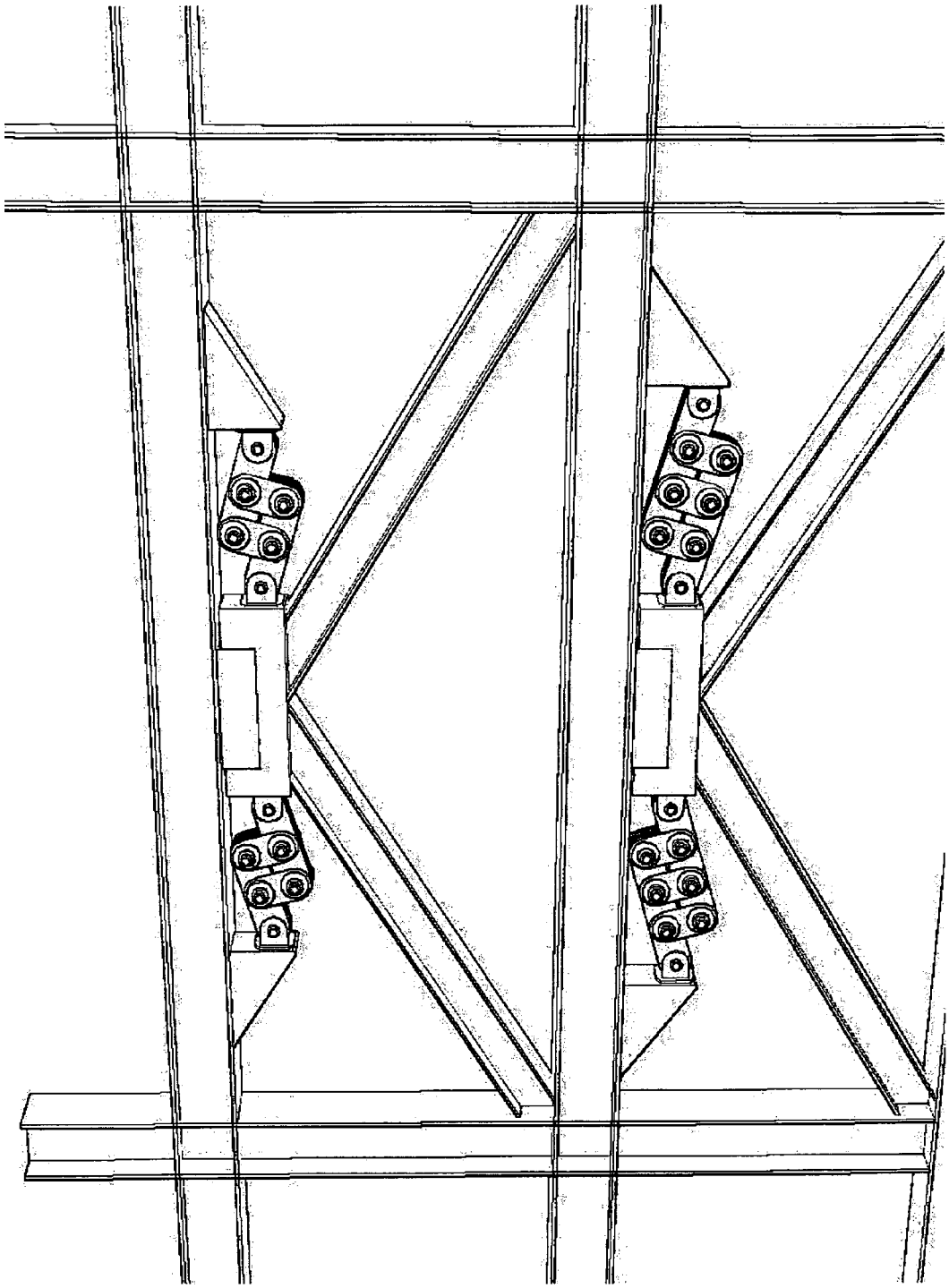
FIG. 12, in a perspective view, shows two different embodiments of dampers and damping systems in accordance with the disclosed embodiments.
Figure 13:
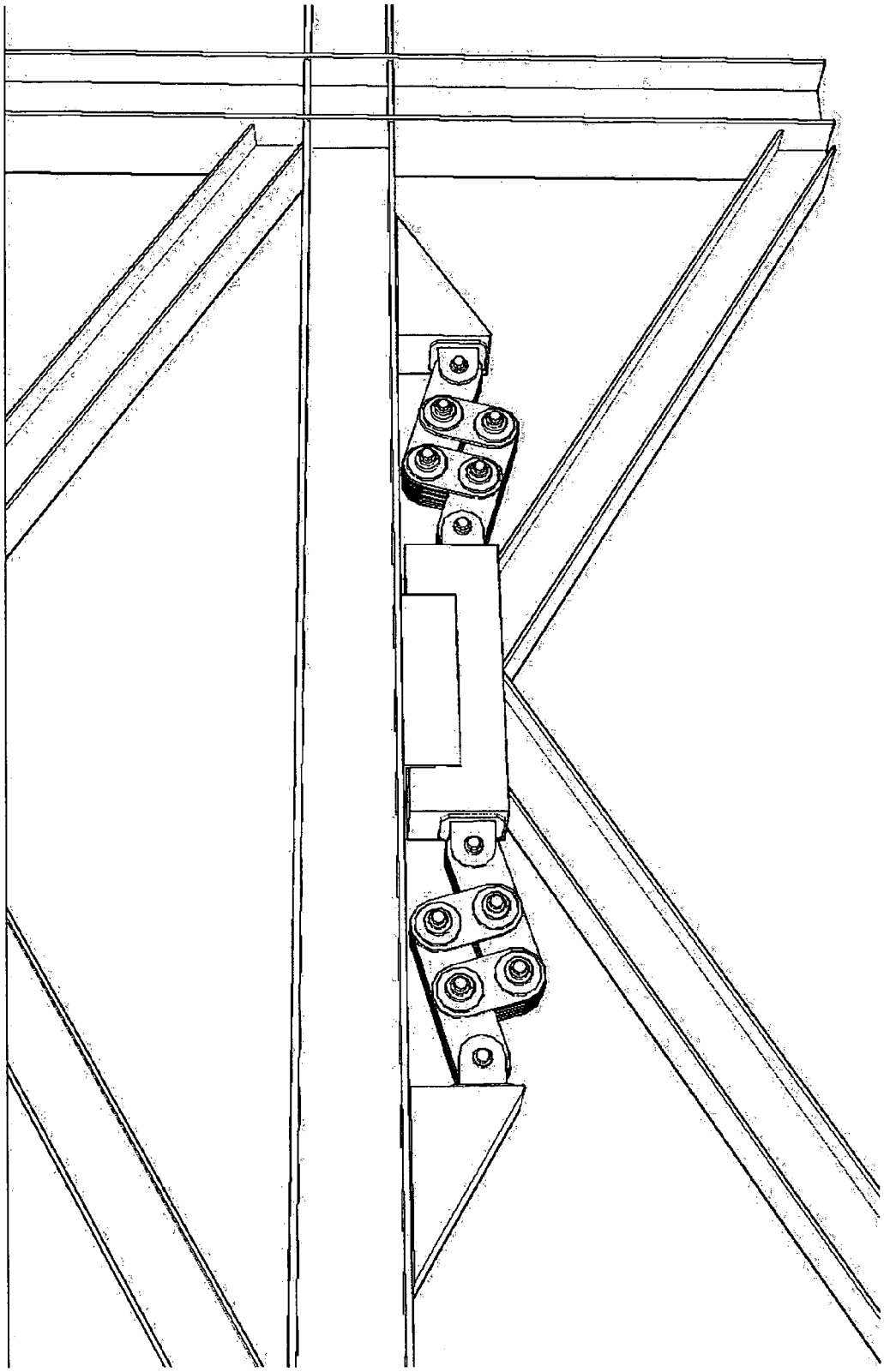
Figure 14:
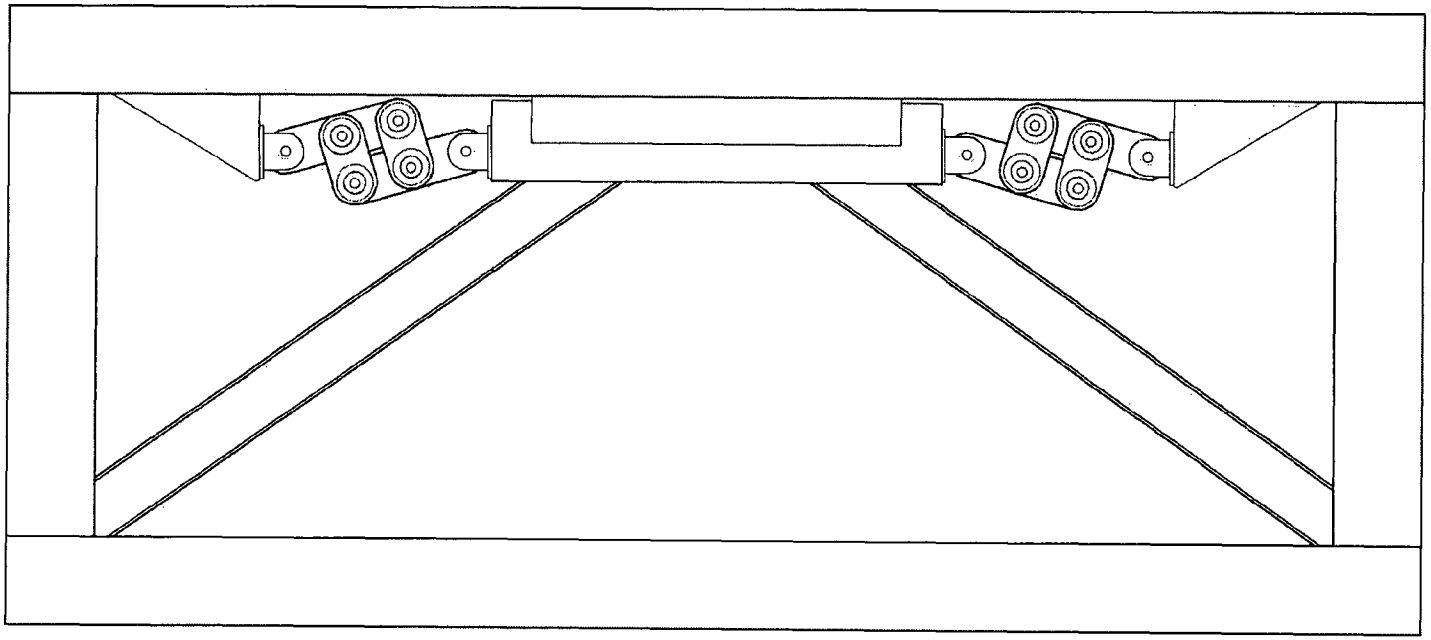
FIG. 14 in a side view, shows details of an embodiment of a damping system.
Figure 15:
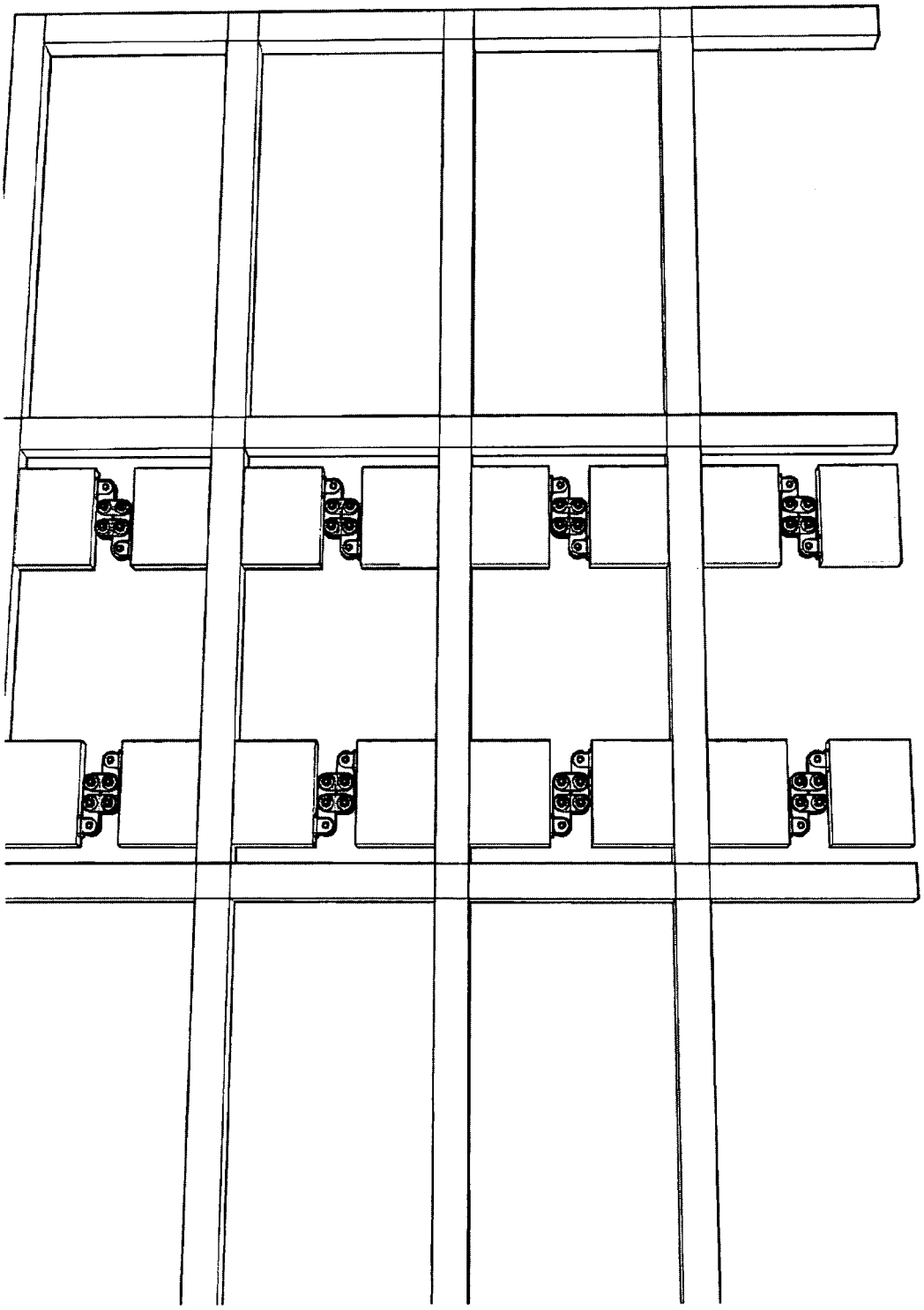
FIGS. 15-19, in various perspective views, show damping systems according to another.
Figure 16:
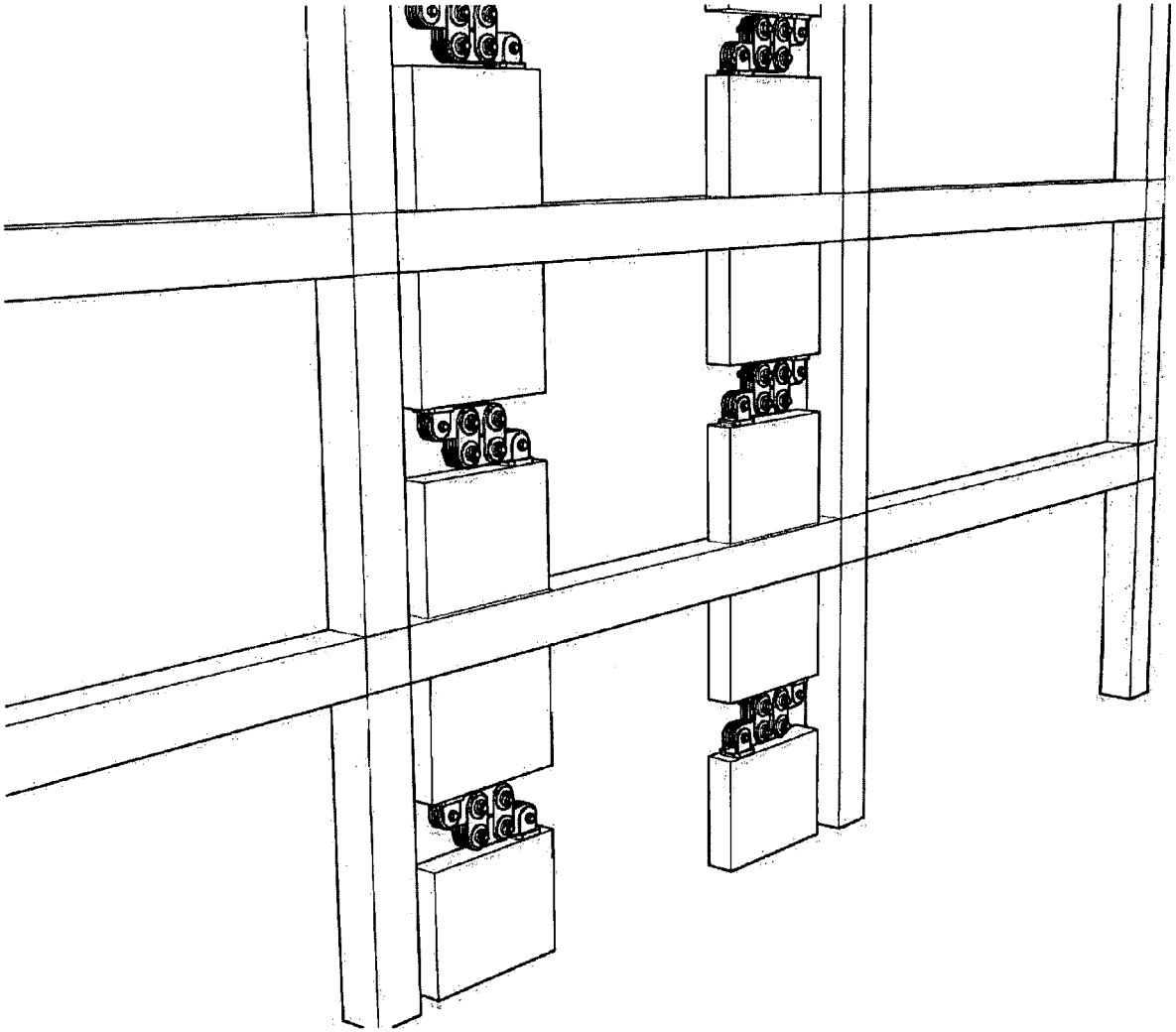
Figure 17:
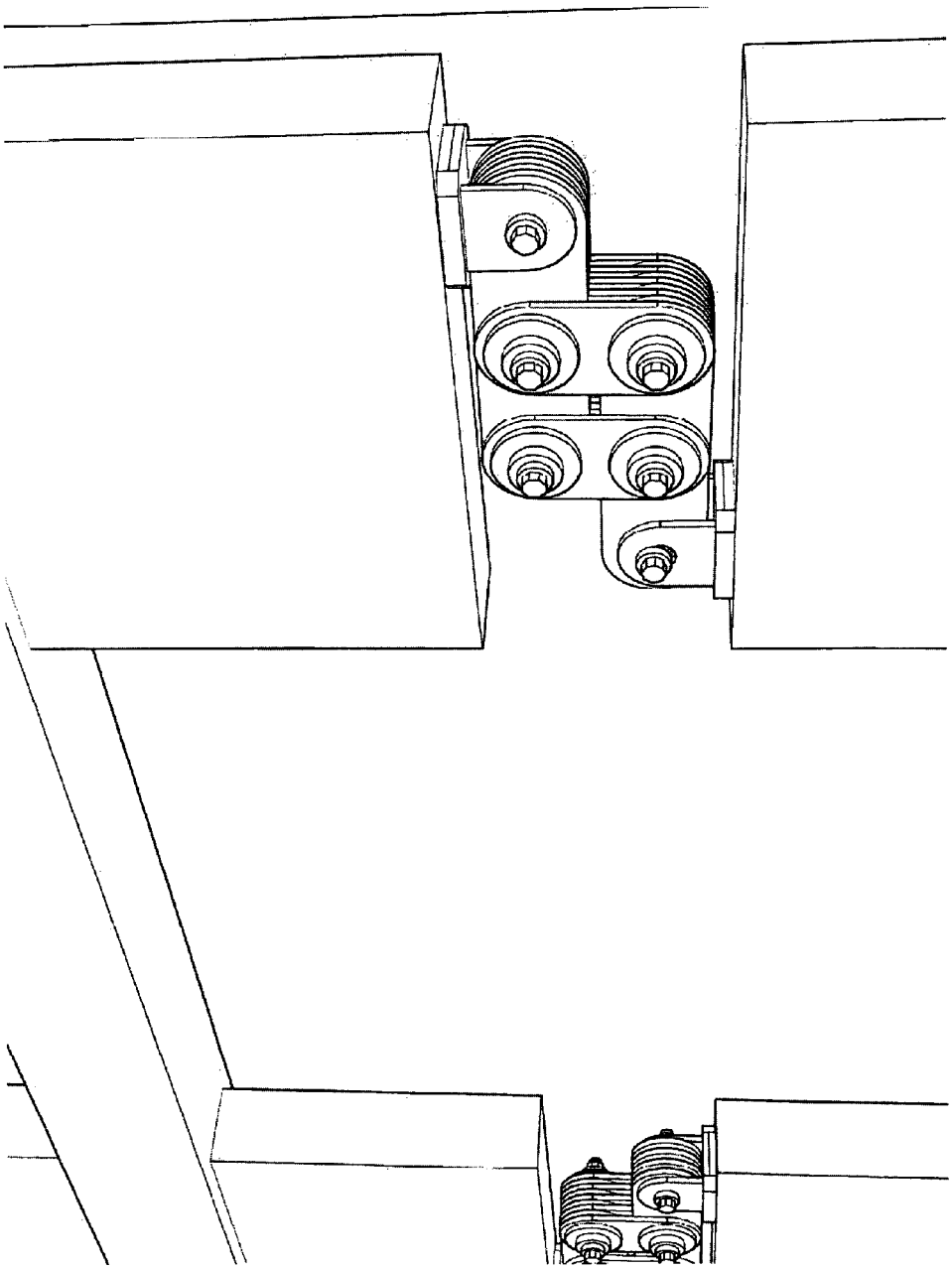
Figure 18:
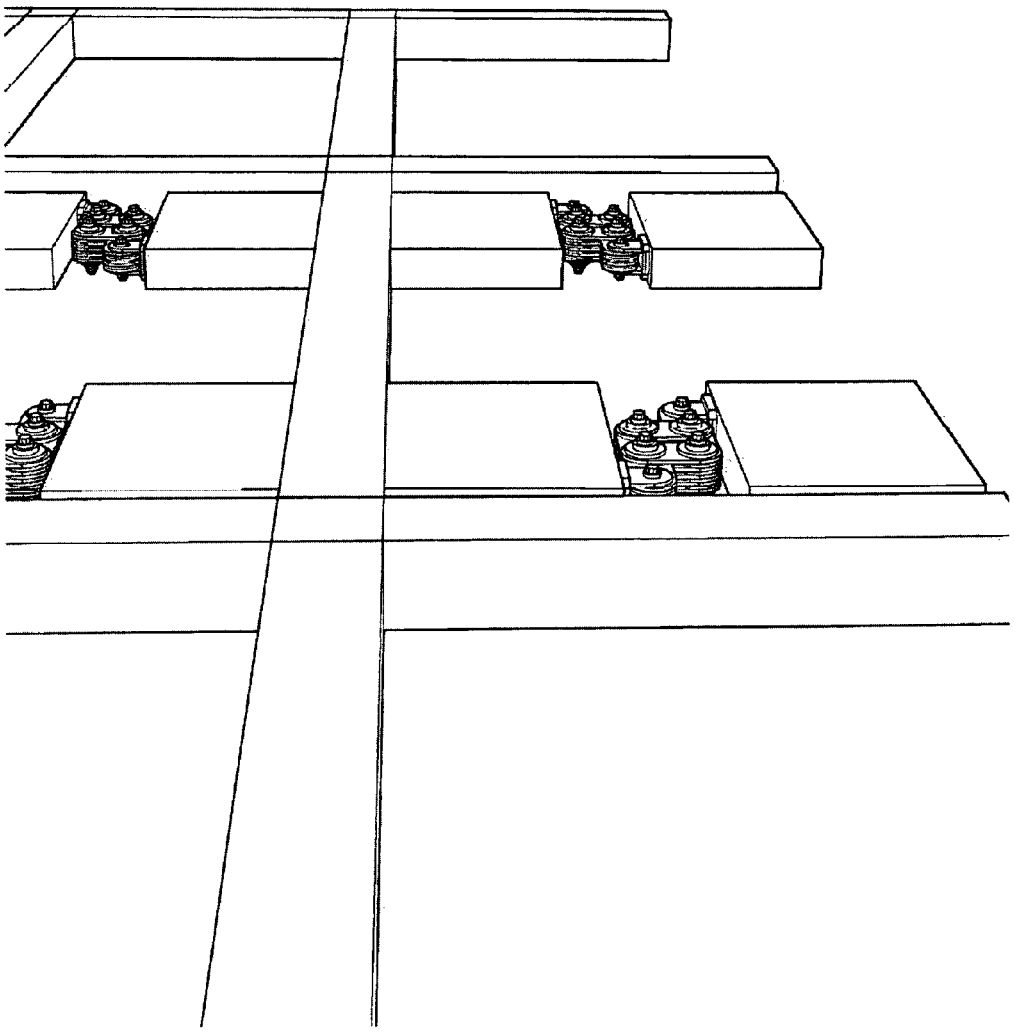
Figure 19:
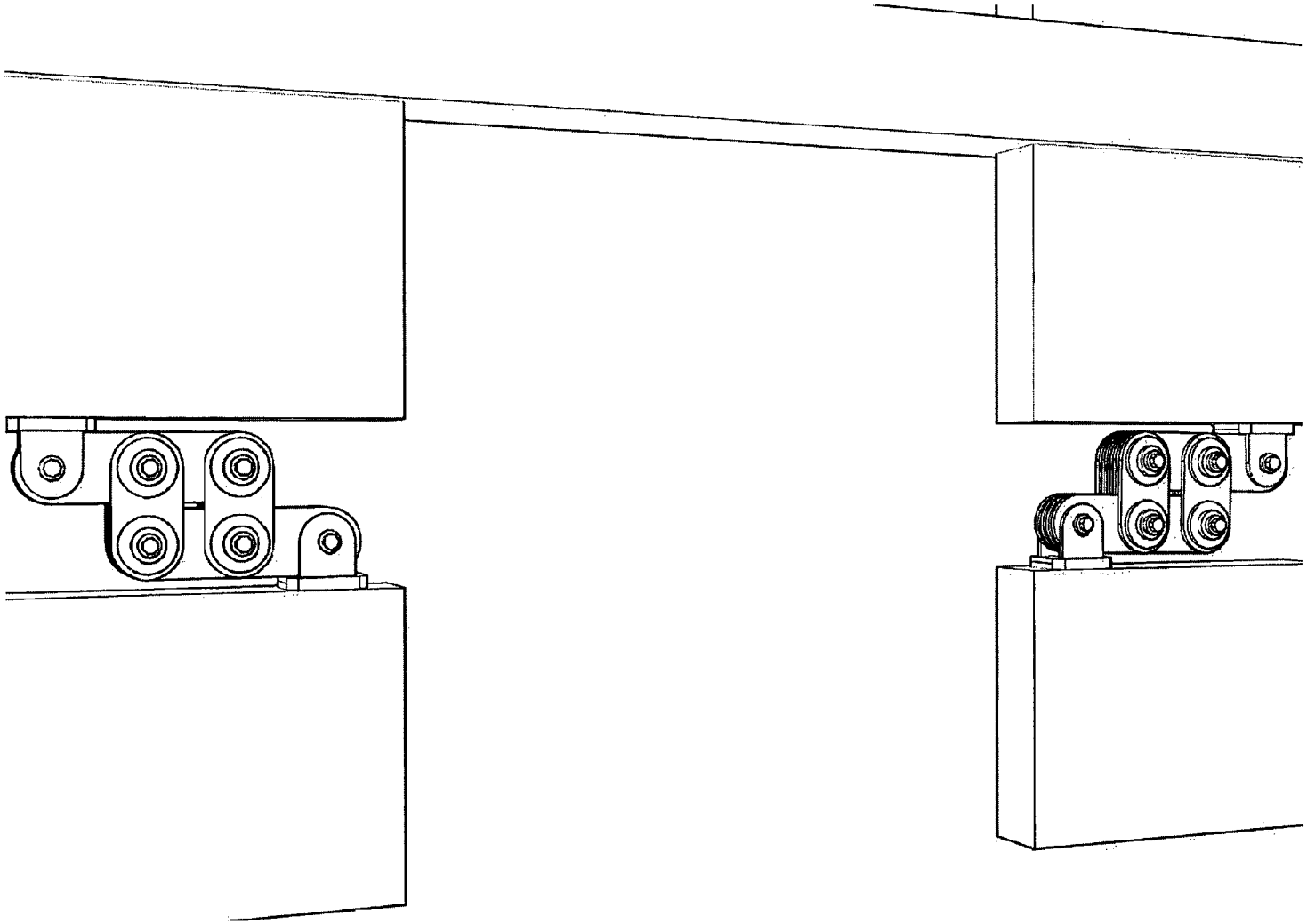

In FIGS. 6 and 7 there is shown a small beam 102 at the tip of the V-formed bracing, structural members 101 or beams. There is a small rectangular plate 500 is to prevent any out of plane movement by preventing movement of the beam sideways or out of plane with respect to a plane defined by the beams 101 arranged in V-shape. A plate 500 may be formed on either side of the small beam 102 or one plate, e.g. in a U-Shape may extend around the small beam. The small plate is fixed to the top beam, 100*c*.

some general specifications for the dampers 1:

The devices for the project are Rotation Friction Dampers (RFD) based on rotation friction concept Dampers have the capacity of; 250, 400, 500, 600 and 700 kN There are 888 dampers for 444 invert V-shape bracings Maximum displacement amplitude is 90 mm The hysterics loops have rectangular shape which provides the maximum energy dissipation.

Dampers 1 should provide very stable slip force over the total displacement (peak to peak)

There are no liquids or oil in the devices

The devices are environmental friendly.

The dampers are adjustable in place at any time.

After major earthquake they are easily fixed if needed in place without a need to send them back to factory.

The dampers are classified as High Damping devices.

Dampers are scaleable in all directions.

They should be easy to maintain in place

Life time of dampers is 20 years

The dampers have a constant slip force in compression and tension

The dampers performance are independent to:

a—Number of cycles b—Frequency c—Displacement Amplitude d—Temperature

The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

Although the present invention has been described in connection with the specified embodiments, it should not be construed as being in any way limited to the presented examples. The scope of the present invention is set out by the accompanying claim set.

The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The invention claimed is:

1. A damping system for constructions having a plurality of structural elements, said system comprising:

a damper;

a first connection member for connecting said damper to said construction; and a second connection member for connecting said damper to said construction, wherein said damper comprises:

at least two sets of first elongate members;

a plurality of sets of second elongate members;

at least one set of second elongate members being rotationally connected to said two sets of first elongate members, each set of second elongate members being arranged in a longitudinal direction along the two sets of first elongate members and in parallel each other; and a set of discs of damping material disposed between said first elongate members and said second elongate members for dampening rotational motion between said first elongate members and said second elongate members, wherein each of said sets of first elongate members comprises one first joint for connecting said damper to one of said connection members, said first joint being disposed at one end portion of each of said set of first elongate members, such that the first joint on one of said first sets of elongate members is arranged at an end portion opposite of the first joint on the other one of said first set of elongate members, wherein the first joint of one of said first set of elongate members is connected to said first connection member and the first joint of the other one of the first sets of elongate members is connected to said second connection member, wherein said first and second connection members connects each of the two sets of first members to said structural elements of the construction structure in second joints.

2. A damping system according to claim 1, wherein the first joint of one of said sets of first elongate members, one of the second joint, the first joint of the other of the set of first elongate members, the other second joint are arranged substantially along a common axis L.

3. A damping system according to claim 1 wherein said sets of first elongate members and said sets of second elongate members are alternately stacked.

4. A damping system according to claim 3, wherein discs of damping material are arranged between alternating stacks of sets of first elongate members and sets of second elongate members.

5. A damping system according to claim 1, wherein said discs of damping material generates damping by friction at surfaces of said first elongate members and sets of second elongate members, where said discs of damping material contacts the surfaces of said sets of first elongate members and said sets of second elongate members.

6. A damping system according to claim 1, wherein said discs of clamping material are formed in a visco-elastic material.

7. A damping system according to claim 1, wherein said damping system comprises a clamping means for providing a clamping force for clamping said sets of first elongate members and said sets of second elongate members against said discs of damping material.

8. A damping system according to claim 7, wherein the clamping force of said clamping means is adjustable.

9. A damping system according to claim 1, wherein the first joints of said first set of elongate members are rotational joints.

10. A damping system according to claim 1, wherein said first and second connections members are rotationally connected to said structural elements.

11. A damping system according to claim 1, wherein one or both of said first and second connections members are formed on a reinforcement part of said structural elements of said construction.

12. A damping system according to claim 1, comprising a rectangular frame of structural elements including a pair of inclined beams, arranged in a V-shape, the inclined beams extending from intersections of said frame, wherein said first connection member is connected to a small beam arranged at a junction of said inclined beams and said second connection member is connected to another structural element or to a reinforcement part.

13. A damping system according to claim 1, comprising a rectangular frame of structural elements and two inclined structural elements connected to diagonally opposite corners of said frame, wherein said first connection member is connected to one of said inclined structural elements and said second connection member is connected to the other one of said inclined structural elements.

14. A damping system according to claim 1, comprising a rectangular frame of structural elements wherein the damper is connected by the first connection member to a first corner of the frame and the second connection member is connected to a second corner diagonally opposite to the first corner of said frame.

15. A damping system for constructions having a plurality of structural elements, said system comprising:

a damper;

a first connection member for connecting said damper to said construction; and a second connection member for connecting said damper to said construction, wherein said damper comprises:

at least two sets of first elongate members;

at least one set of second elongate members being rotationally connected to said two sets of first elongate members; and a set of discs of damping material disposed between said first elongate members and said second elongate members for dampening rotational motion between said first elongate members and said second elongate members, wherein each of said sets of first elongate members comprises one first joint for connecting said damper to one of said connection members, said first joint being disposed at one end portion of each of said set of first elongate members, such that the first joint on one of said first sets of elongate members is arranged at an end portion opposite of the first joint on the other one of said first set of elongate members;

wherein the first joint of one of said first set of elongate members is connected to said first connection member and the first joint of the other one of the first sets of elongate members is connected to said second connection member;

wherein said first and second connection members connects each of the two sets of first members to said structural elements of the construction structure in second joints; and a rectangular frame of structural elements including a pair of inclined beams, arranged in a V-shape, the inclined beams extending from intersections of said frame, wherein said first connection member is connected to a small beam arranged at a junction of said inclined beams and said second connection member is connected to another structural element or to a reinforcement part.

16. A damping system according to claim 15, wherein one or both of said first and second connections members are formed on a reinforcement part of said structural elements of said construction.

17. A damping system for constructions having a plurality of structural elements, said system comprising:

a damper;

a first connection member for connecting said damper to said construction; and a second connection member for connecting said damper to said construction, wherein said damper comprises:

at least two sets of first elongate members;

at least one set of second elongate members being rotationally connected to said two sets of first elongate members; and a set of discs of damping material disposed between said first elongate members and said second elongate members for dampening rotational motion between said first elongate members and said second elongate members, wherein each of said sets of first elongate members comprises one first joint for connecting said damper to one of said connection members, said first joint being disposed at one end portion of each of said set of first elongate members, such that the first joint on one of said first sets of elongate members is arranged at an end portion opposite of the first joint on the other one of said first set of elongate members, wherein the first joint of one of said first set of elongate members is connected to said first connection member and the first joint of the other one of the first sets of elongate members is connected to said second connection member, wherein said first and second connection members connects each of the two sets of first members to said structural elements of the construction structure in second joints; and a rectangular frame of structural elements and two inclined structural elements connected to diagonally opposite corners of said frame, wherein said first connection member is connected to one of said inclined structural elements and said second connection member is connected to the other one of said inclined structural elements.

18. A damping system according to claim 17, wherein one or both of said first and second connections members are formed on a reinforcement part of said structural elements of said construction.

* * * * *